US006799519B2

(12) United States Patent
Meyer et al.

(10) Patent No.: US 6,799,519 B2
(45) **Date of Patent: *Oct. 5, 2004**

(54) SABOT FOR A BULLET

(75) Inventors: Stephen W. Meyer, Alhambra, IL (US); Robert J. Gardner, Bethalto, IL (US); Gerald T. Eberhart, Bethalto, IL (US)

(73) Assignee: Olin Corporation, East Alton, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/384,039

(22) Filed: Mar. 7, 2003

(65) Prior Publication Data

US 2003/0164111 A1 Sep. 4, 2003

Related U.S. Application Data

(62) Division of application No. 09/686,608, filed on Oct. 11, 2000, now Pat. No. 6,564,720.
(60) Provisional application No. 60/176,217, filed on Jan. 14, 2000.

(51) Int. Cl.[7] ..... F42B 14/08
(52) U.S. Cl. ..... 102/522; 102/521; 102/523; 102/439
(58) Field of Search ..... 102/520, 521, 102/522, 523, 439

(56) References Cited

U.S. PATENT DOCUMENTS

| | | | | |
|---|---|---|---|---|
| 2,638,051 A | | 5/1953 | Critchfield | |
| 3,005,408 A | | 10/1961 | Prosen et al. | |
| 3,164,092 A | | 1/1965 | Reed et al. | |
| 3,726,231 A | | 4/1973 | Kelly et al. | |
| 4,488,491 A | | 12/1984 | Rhodes | 102/522 |
| 4,574,703 A | | 3/1986 | Halverson | 102/520 |
| 4,644,865 A | | 2/1987 | Lawrence | 102/430 |
| 4,653,404 A | | 3/1987 | Halverson | 102/520 |
| 4,709,638 A | | 12/1987 | Broden et al. | 102/522 |
| 4,735,147 A | | 4/1988 | Halverson | 102/520 |
| 4,735,148 A | | 4/1988 | Holtzman et al. | 102/522 |
| 4,750,425 A | | 6/1988 | Sigg et al. | 102/357 |
| 4,776,280 A | | 10/1988 | Burri et al. | 102/523 |
| 4,815,682 A | * | 3/1989 | Feldmann et al. | 244/3.23 |
| 4,854,242 A | | 8/1989 | Katzmann | 102/522 |
| 4,881,466 A | | 11/1989 | McGinley | 102/522 |
| 4,913,054 A | | 4/1990 | Peterson | 102/439 |
| 5,016,538 A | | 5/1991 | Sowash | 102/520 |
| 5,178,389 A | | 1/1993 | Bentley et al. | |

(List continued on next page.)

FOREIGN PATENT DOCUMENTS

| | | | | |
|---|---|---|---|---|
| CH | 675769 A5 | * | 10/1990 | 102/522 |
| DE | 2 227 656 | * | 1/1973 | 102/520 |
| DE | 41 33 617 A1 | * | 4/1993 | 102/521 |
| GB | 2 251 480 A | * | 7/1992 | 102/522 |
| IT | 427344 | * | 9/1948 | 102/520 |
| WO | WO 83/01300 | * | 4/1983 | 102/523 |

*Primary Examiner*—Stephen M. Johnson
(74) *Attorney, Agent, or Firm*—Wiggin and Dana LLP; Gregory S. Rosenblatt

(57) ABSTRACT

A plastic, cup-shaped, multi-petal sabot housing a sub-caliber projectile for use such as in shotgun cartridges. The sabot engages the rifling of the shotgun barrel and transfers the spin to the projectile. A reinforcement disk is advantageously at least partially embedded in a sabot base and has a central aperture and a plurality of additional apertures. Sabot base material extends through the additional apertures. Advantageously, in its relaxed condition, each sabot petal includes a protrusion from its inboard surface for engaging a projectile ogive. The protrusion and its contact area with the projectile are fractions of the local petal width.

3 Claims, 4 Drawing Sheets

U.S. PATENT DOCUMENTS

| | | | | | |
|---|---|---|---|---|---|
| 5,214,238 | A | | 5/1993 | Young | 102/520 |
| 5,235,915 | A | | 8/1993 | Stevens | 102/439 |
| 5,339,743 | A | | 8/1994 | Scarlata | 102/439 |
| 5,361,701 | A | | 11/1994 | Stevens | 102/450 |
| 5,388,523 | A | * | 2/1995 | Rossmann | 102/521 |
| 5,400,716 | A | | 3/1995 | Mayer | 102/507 |
| 5,404,815 | A | * | 4/1995 | Reed | 102/507 |
| 5,415,102 | A | | 5/1995 | White et al. | 102/522 |
| 6,073,560 | A | | 6/2000 | Stone | 102/522 |
| 6,564,720 | B1 | * | 5/2003 | Meyer et al. | 102/522 |

* cited by examiner

SABOT FOR A BULLET

CROSS-REFERENCE TO RELATED APPLICATIONS

This patent application claims priority of U.S. Provisional Patent Application Ser. No. 60/176,217, entitled "SABOT FOR A BULLET" filed Jan. 14, 2000. This application is a divisional application of U.S. patent application Ser. No.09/686,608, entitled "SABOT FOR A BULLET", filed Oct. 11, 2000, now U.S. Pat. No. 6,564,720. The disclosure of these U.S. patent documents are incorporated by reference herein in their entireties.

BACKGROUND OF THE INVENTION (1) Field of the Invention

This invention relates to firearms ammunition, and more particularly to sabots for use with shotguns, muzzle-loading rifles, and the like.

(2) Description of the Related Art

The use of slugs with shotguns is intertwined with the history of shotguns themselves. U.S. Pat. No. 3,726,231 discloses a waisted slug known as the BRI slug or bullet. Such waisted slugs grew to prominence in the 1970's and 1980's. That time period saw increased interest in use of shotgun slug motivated by a combination of user preference and regulatory influence. The availability of rifled shotgun barrels also increased, further enhancing slug performance.

In parallel, the field of muzzle-loading rifles continues to flourish with a dedicated following. This field also provides fertile ground for use of saboted projectiles.

There are ongoing development efforts in saboted projectile technology. U.S. Pat. No. 5,214,238 discloses a sabot for chambering conventional bullets in a shotgun. U.S. Pat. No. 5,415,102 discloses a muzzle loading sabot. General dimensions of shotshells and pistol bullets are respectively disclosed in American National Standard Voluntary Industry Performance Standards for Pressure and Velocity of Shotshell Ammunition for the Use of Commercial Manufacturers and in Voluntary Industry Performance Standards for Pressure and Velocity of Centerfire Pistol and Revolver Ammunition for the Use of Commercial Manufacturers ANSI/SAAMI Z299.2-1992 and Z299.3-1993 (American National Standards Institute, New York, N.Y.).

There, however, remains room for further improvement in the field.

BRIEF SUMMARY OF THE INVENTION

Accordingly, in one aspect, the invention is directed to a sabot for firing a subcaliber projectile from a firearm. The sabot includes a molded member, preferably formed of a plastic. The molded member includes a base and a number of petals each extending forward from a proximal root at the base to a distal tip. Each petal cooperates with the base to define a volume for accommodating the projectile in a pre-firing condition. A reinforcement is at least partially embedded in the base and is more rigid than the molded member. The reinforcement includes fore and aft faces and a lateral perimeter. The reinforcement includes a central aperture along a central longitudinal axis of the projectile and a number of additional apertures. The material of the base portion extends through the additional apertures and is effective to retain the reinforcement within the molded member upon firing.

In implementations of the invention, the reinforcement is preferably metal. The additional apertures are preferably chamfered at least at the fore face. The base preferably includes a centrally-apertured web along the reinforcement fore face. The reinforcement perimeter preferably extends beneath the roots of the petals. There may be exactly four petals separated from each other by four circumferential gaps extending between sabot interior and exterior circumferential surfaces. Each petal may have inboard and outboard surface portions and a pair of connecting surfaces along the adjacent gaps. The gaps may be substantially wider at the exterior circumferential surface than at the interior circumferential surface.

The molded member may consist essentially of a polyethylene while the reinforcement may be a pressed iron-based material. The petal inboard surface portions may include a proximal portion with a first diameter effective to cooperate with a cylindrical body of the projectile and a distal portion formed as a protuberance having a surface portion for engaging an ogive of the projectile. Such surface portion may be of circumferential extent smaller in angle than the proximal portion. The adjacent connecting surfaces of adjacent petals may be substantially flat and oriented relative to each other at an angle of between 80 and 100 degrees about the central axis. The projectile maybe an ogival hollow-point bullet of maximum diameter between 0.4200 inch and 0.5100 inch or, more narrowly, 0.4300 inch and 0.5100 inch. The saboted projectile may be loaded in a shotshell hull with propellant, a shotshell primer, and wadding to form a loaded shell. The shell may be dimensioned for firing from a 20-gauge or a 12-gauge shotgun. The projectile may be a partition bullet having a front core and a rear core which is harder than the front core. The rear core may comprise a lead-antimony alloy and the front core may comprise a lead-based material. The alloy may have at least 2% antimony, by weight, whereas the front core material may preferably have less than 1% antimony. The sabot may be dimensioned for firing from a 12 gauge shotgun while the bullet maybe a 0.50 caliber secant ogive partition bullet.

In another aspect, the invention is directed to a method for manufacturing a saboted bullet. A bullet is provided. A reinforcement is provided having a plurality of apertures. The reinforcement is held and the sabot body is molded therearound so that material from the sabot body flows into the apertures and extends therethrough so as to link a portion of the body forward of the reinforcement to a portion of the body after the reinforcement. The bullet is inserted into the sabot body through a fore end thereof.

In various implementation of the invention, the bullet may have a nominal caliber of 0.44, 0.45, or 0.50. The sabot may have dimensions effective to fire the bullet from a 20-gauge shotgun if the bullet is 0.44 or 0.45 caliber or a 12 -gauge shotgun if the bullet is 0.50 caliber. The step of inserting may cause the bullet to flex petals of the sabot outward as the bullet enters the sabot and then allow the petals to at least partially return to an unflexed condition as the bullet nears a fully-installed position.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
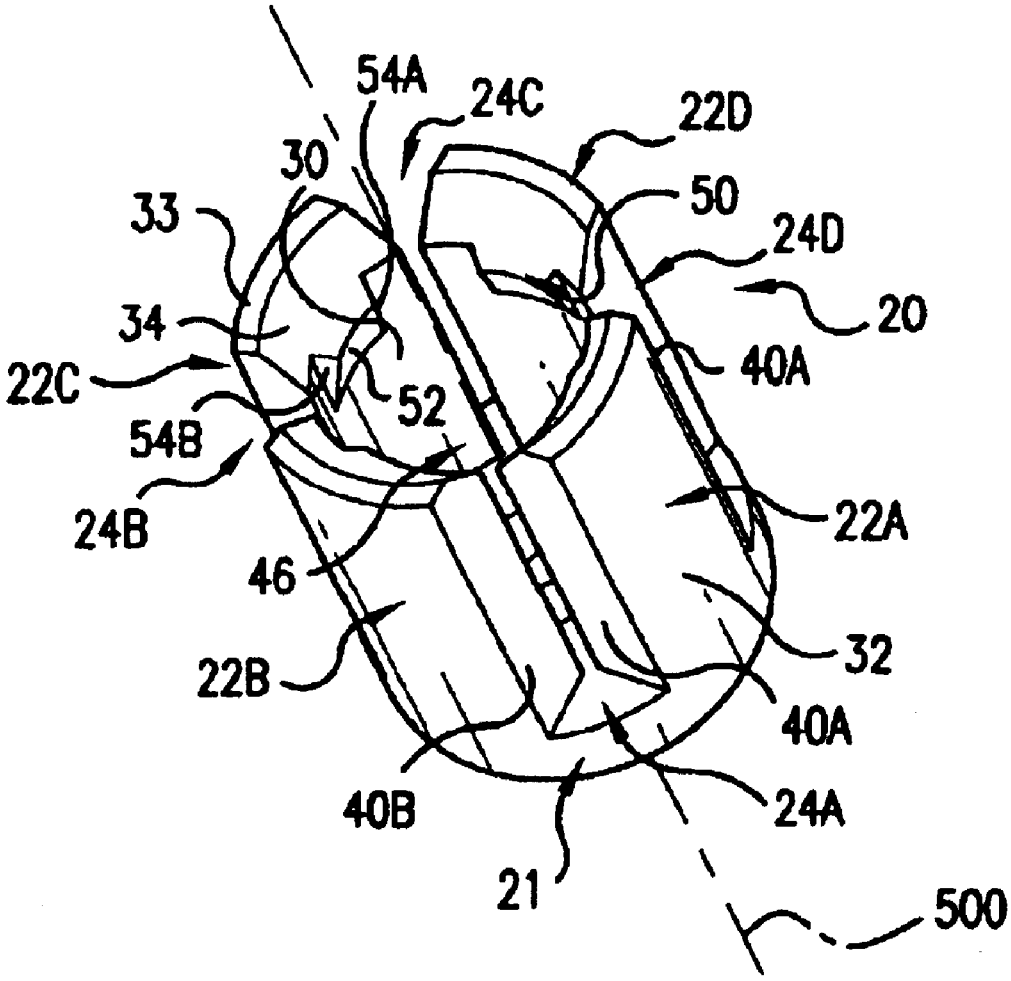
FIG. 1 is a view of a sabot according to principles of the invention.
Figure 2:
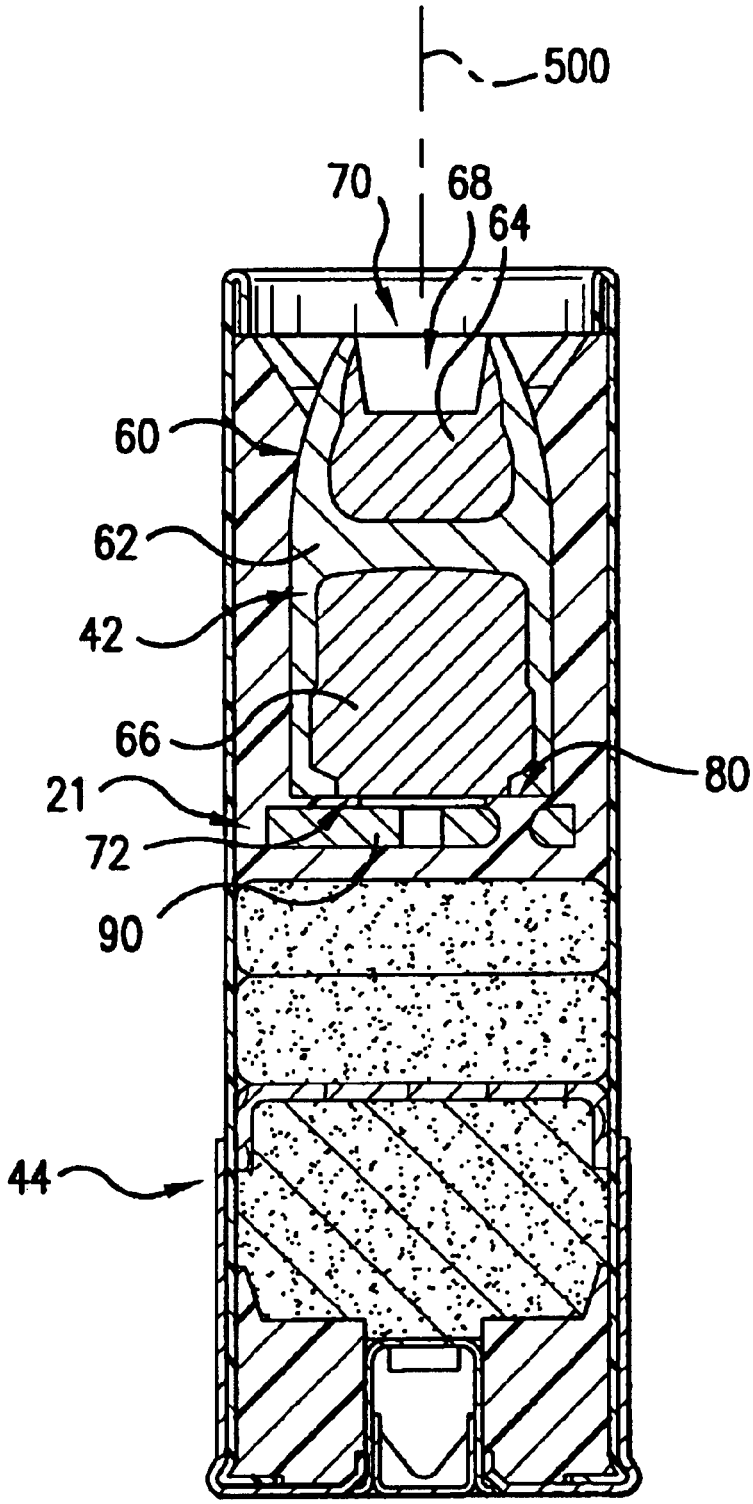
FIG. 2 is a longitudinal sectional view of a shell including the sabot of FIG. 1.
Figure 3:
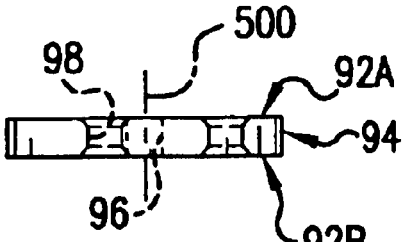
FIGS. 3 and 4 and side and top (forward) views of a reinforcement disk of the sabot of FIG. 1.
Figure 4:
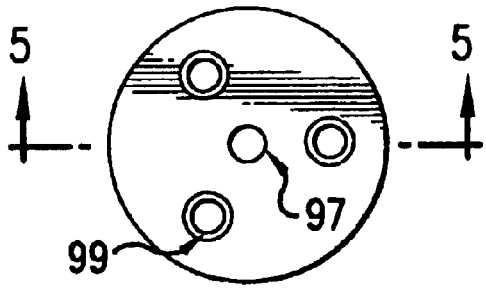
Figure 5:
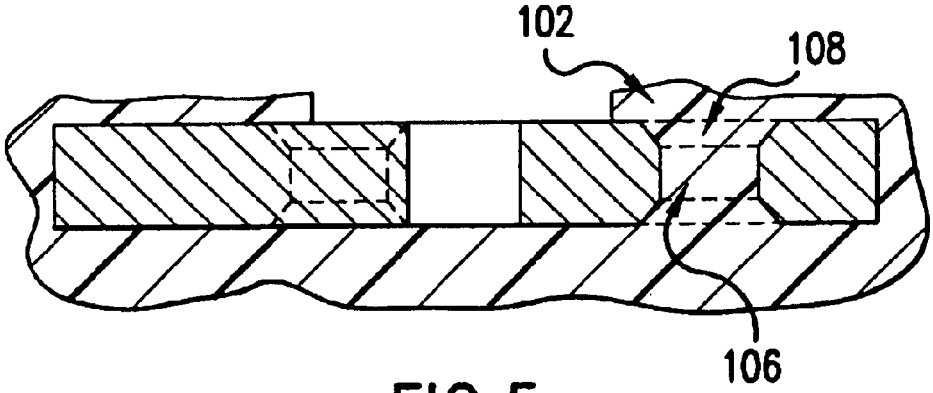
FIG. 5 is a partial cross-sectional view of a base of the sabot of FIG. 1.

FIGS. 1–7 show an exemplary sabot with proportions and dimensions believed advantageous for chambering a 0.50 caliber bullet in a 12-gauge shotgun. Appropriate scaling would provide for other shotgun gauges and bullet calibers, and yet further applications such as muzzle-loading rifles.

The sabot 20 includes a body formed as unitary one-piece plastic molding comprising a base 21 and an exemplary four petals 22A–22D extending forward from proximal roots at the base 21 to distal tips. The petals are separated from each other by an equal number of gaps or slits 24A–24D. Each petal has an inboard surface portion 30 and an outboard surface 32. Each petal also includes a distal annular forward-facing rim surface 33 and a tapering, substantially frustoconical, surface 34 connecting the rim surface to the inboard surface portion 30. Each petal also includes respective first and second lateral surfaces 40A and 40B connecting its inboard and outboard surfaces and extending along and defining one side of the adjacent gap. The illustrated sabot is shown in a relaxed condition generally corresponding to the shape of the mold in which it is made. Artifacts of manufacturing (e.g., the cooling process) may produce some insubstantial departures from this ideal. The sabot has a central longitudinal axis 500 which also defines the central longitudinal axis of the bullet 42 that it carries (FIG. 2), the shotshell hull 44 into which it is loaded, and the barrel (not shown) of the firearm from which it is fired.

Returning to FIG. 1, the petals and base cooperate to define a compartment 46 for receiving the bullet. Extending inboard of the cylinder defined by the surfaces 30, each petal has a protrusion 50 having a forward surface being the continuation of the surface 34 and having an inboard forwardly tapering surface 52 merging with the continuation of the surface 34 at a fore end and merging with the surface 30 at a rear end. Along sides of the protrusions, a pair of side surfaces 54A and 54B join the surfaces 30, 34, and 52. The surface 52 is shaped to engage the ogive 60 (FIG. 2) of the bullet 42 when the bullet is loaded in the sabot and the sabot is loaded in the shotshell hull 44.

The exemplary bullet 42 is a partition-type bullet having a jacket 62 and containing front and rear cores 64 and 66 separated by a transverse web of the jacket. A forward end of the front core 64 surrounds a cavity 68 at the bullet nose 70 while a rear end of the rear core cooperates with a rear rim of the jacket to define a bullet base 72. The bullet is loaded into the sabot from the front, with the bullet base having a camming interaction with the continuation of the surfaces 34 along the projections 50 to flex the petals outward at their tips. The cylindrical body portion of the bullet then slips through the projections into the compartment until the bullet ogive reaches the projections, whereupon the petals may flex back toward the relaxed condition. With the bullet fully inserted and its base 72 engaging the forward surface 80 of the sabot base 21, the petals may still be flexed somewhat outward by the presence of the bullet. When the sabot is loaded in the shotshell hull 44, inward compression applied by the hull tube to the petals brings the projections into engagement with the bullet ogive and brings the portions of the surface 30 below (behind) the projections into fuller engagement with the bullet body. This helps assure firm frictional engagement between the bullet and the sabot to allow transmission of spin from the sabot to the bullet.

Exemplary materials for the jacket, front core, and rear core are brass, a relatively soft lead-based material, and a relatively hard lead-based material. An exemplary brass is CDA210. An exemplary soft lead-based material is a substantially pure lead. An exemplary hard lead-based material is a 2.5% antimony-lead alloy. The soft material of the front core aids in deformation upon impact while the hardness of the material of the rear core resists a tendency of the rear core material deform rearwardly under the acceleration of firing (e.g., to avoid setback extrusion of the rear core material into the material of and aperture(s) in the sabot base). By thus maintaining bullet integrity, advantageous ballistic performance can be maintained. Other bullet constructions and other materials may nevertheless be used.

Figure 6:
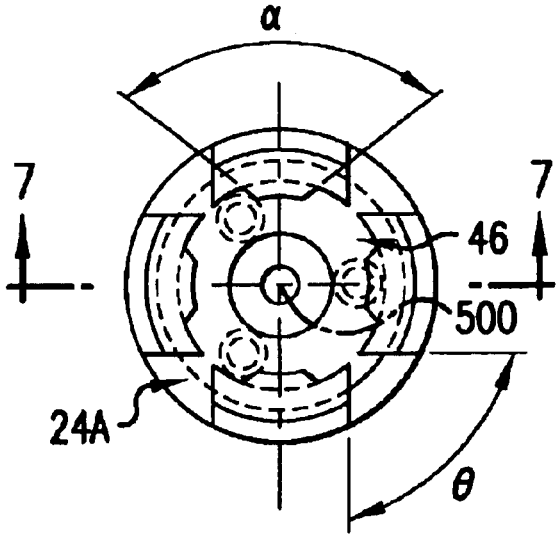
FIG. 6 is a top view of the sabot of FIG. 1.
Figure 7:
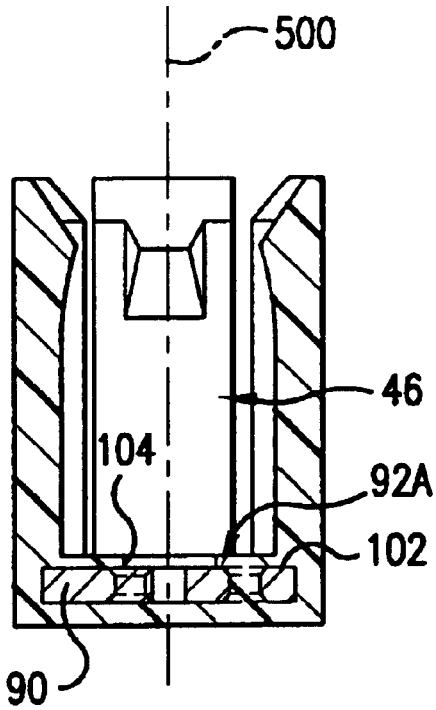
FIG. 7 is a cross-sectional view of the sabot of FIG. 6 taken along line 7—7.

Embedded within the sabot base 21 is a reinforcement or area multiplier 90. The exemplary area multiplier is formed as a metallic disk (FIGS. 3 and 4) having fore and aft surfaces 92A and 92B joined by a lateral perimeter surface 94. Extending between fore and aft surfaces are a surface 96 defining a central cylindrical aperture 97 and three surfaces 98 defining apertures 99 radially offset from the axis 500. The exemplary surface 96 is cylindrical while the exemplary surfaces 98 (and their associated apertures) are formed with a central cylindrical portion and upper and lower diverging frustoconical portions (the functions of which are described below). The sabot base (FIG. 5) includes a thin web of material 102 extending between the base forward surface 80 and the disk fore surface 92A. An inboard surface 104 of the web 102 defines a central aperture exposing a coaligned portion of the disk fore surface 92A to the compartment 46 (FIGS. 6 and 7).

The interior surfaces of the four petals conform to the shape of the bullet body. Additionally, the interior surfaces of the four petals contain the projections 50 which conform to the ogival shape of the nose of the bullet. The projections 50 serve to contain the bullet in the sabot prior to firing, and to provide additional sabot/bullet contact area for the purpose of transferring rotation to the bullet when fired from a rifled barrel. An exemplary width of the projection for the exemplary sabot is roughly half the width of the petal measured at an intermediate location along the projection inner surface. This ratio represents a compromise between maximizing contact area, and minimizing material cost and part weight. Projection width in the range of ¼ petal width to ¾ petal width would also be appropriate.

The width of the slits 24A–24D increases in the outward radial direction. This provides a relatively high contact area between the sabot and the bullet side surface. The greater slit width where petal outboard surfaces 32 contact the barrel provides room for plastic to "flow" to avoid potential barrel deformation due to stresses brought on by the sabot engagement in the barrel rifling. Desirable slit width at the inboard surface 30 would be in the range of 0.020–0.080 inch. The radial lines (planes) establishing the varying slit width form an angle 2 advantageously in the range of 45° to 135°. A more preferred range is 80°–110° with about 90° as exemplary. An angle ∀ between projection side surfaces may be similar. In the exemplary 12-gauge embodiment, petal width is approximately 0.327 inch, overall length approximately 1.080 inch, overall diameter approximately 0.727 inch, web thickness approximately 0.018 inch, sabot base overall thickness approximately 0.163 inch, a petal length to the base of the projection approximately 0.587 inch, and an angle between the surfaces 34 and the central axis 500 is 35°.

Preferred material for the sabot body is a high density polyethylene (e.g., 94% HDPE, 6% impact modifier). An exemplary impact modifier is a very low density linear low density polyethylene (VLDLLDPE) sold by DuPont Dow Elastomers, LLC, Wilmington, Del., under the trademark Engage 8200NT. The desirable properties of this plastic include cold temperature flexibility and softness. Cold temperature flexibility assists in keeping the petals attached to the sabot base during muzzle exit when firing cartridges (shells) subjected to cold temperature storage. A relative soft plastic is desirable to permit material flow and deformation to avoid potential barrel damage.

In operation, upon firing the area multiplier disk 90 disperses the bullet setback forces over a larger base area. The disk is of appropriate thickness and hardness to resist any substantial deformation from the setback forces and provides a flat surface from which the bullet is launched. Without the area multiplier, a plastic sabot base would tend to deform due to the setback forces and surround the heel (base) of the bullet. This would negatively affect bullet accuracy. A desirable range of thickness for the area multiplier is dependent on material hardness and strength. For cold rolled steel or a pressed and sintered iron powder, a desirable range would be greater than 0.040 inch to resist deformation and less than 0.120 inch to minimize weight, while an exemplary 12-gauge embodiment is 0.080 inch. The use of powder metallurgy may be particularly cost-effective in manufacturing the disk.

The diameter of the area multiplier affects: 1) the resistance of the petals to flexing; and 2) the degree of setback deformation experienced by the sabot base. The former results from the degree by which the area multiplier undercuts the petal root portions, thereby weakening such portions. The petal roots or attachments form hinges which flex to permit the petals to open under the aerodynamic forces and/or centripetal acceleration experienced upon muzzle exit. Too large a diameter may result in thin petal attachments which break (usually non-uniformly causing poor accuracy) at muzzle exit, or even in-bore. Too small a diameter may reduce the area multiplier effect of force dispersion, and result in unwanted base deformation which can interact with the bullet heel during separation. Also, the associated thick petal attachments may reduce hinging flexibility at the petal root which impedes release of the bullet. A desirable range of the diameter is believed to provide that the disk circumference extends into the middle half of the radial span of petal thickness (i.e. the OD at the perimeter surface 94 is within the middle half of the radial span between surfaces 30 and 32).

The disk central aperture 97 provides for centering and holding the disk during an insert molding process. The apertures 99 allow plastic to flow into/through the disk during the insert molding process to form "rivets" 106 (FIG. 5) to hold the disk in place. The bevel, chamfer or generous radius of the apertures 99 at least at the fore surface of the disk creates a rivet "head" 108 to provide a secure attachment of the disk to the sabot base. The apertures 99 are also beveled, chamfered or radiused on the aft surface of the disk to strengthen the attachment of the rear ends of the rivets to the remainder of the sabot base. The apertures 99 are equally spaced from each other, and from the central aperture 97, to maintain mass balance for stable spin. The radial spacing should be such that the chamfer does not go beyond the inside diameter of the petals at the inboard surfaces 30 (or diameter of the bullet). Allowing this could result in one or more of the rivets substantially strengthening the connection of the sabot base to one or more petals, depending on orientation of the rivets relative to the petals in the insert molding operation. This could result in non-uniform petal opening and degrade bullet accuracy. Use of expensive insert placement equipment would permit proper angular positioning, and lining up of four rivet holes holes with four petals (or slits) which may be beneficial for uniform petal opening. A desirable range for the diameter of the rivet post is believed to be 0.040–0.120 inch or about the disk thickness, with the rivet head and rivet base diameters being approximately 50% larger due to the bevel, chamfer or radius. The desirable number of apertures 99 would be two to four.

The web 102 connects the four petals and the rivet heads in the chamfers. This feature provides additional securement of the disk to the sabot base. A desirable range of web thickness would be 0.005–0.050 inch.

In the absence of the securement of the disk to the sabot base as it is provided by the rivets and web, it is believed that the disk could separate from the sabot base upon petal blossoming and follow the bullet base a considerable distance causing unsatisfactory bullet accuracy. Additionally, the separated area multiplier could travel a considerable distance (e.g., in excess of 100 yards) and become an undesirable secondary projectile.

In an exemplary 12-gauge load, a 48 grain charge of OBP 505 BALL powder of Primex Technologies Inc., St. Marks, Fla., is utilized. The select propellant combines desirable characteristics of a low burn rate, good ignition properties, and low muzzle flash to achieve high velocity and good accuracy. A wad column is provided consisting of a paper over-powder cup for gas sealing, a fiber wad forward thereof for ballistic cushioning, and a relatively stiff card wad forward thereof to support the sabot. The bullet has a mass of 385 grains, an overall length of 0.915 inch, and a maximum (body) diameter of 0.501 inch. When fired from a 30 inch test barrel, typical pressure and velocity values are 11,000 psi and 1,825 fps. An advantageous muzzle velocity range would be 1700–2000 fps. Typical accuracy values for bullets fired from a 26 inch test barrel with 1 in 35 inch rifling twist are 3.5 inch groupings of 5 shot targets.

One or more embodiments of the present invention have been described. Nevertheless, it will be understood that various modifications may be made without departing from the spirit and scope of the invention. For example, manufacturing techniques, equipment, and materials may vary and varying artifacts of manufacture may arise. Accordingly, other embodiments are within the scope of the following claims.

What is claimed is:

1. A sabot and bullet combination, comprising:

said bullet; and said sabot, having a reinforcement member having a plurality of apertures;

a molded sabot body around the reinforcement member, so that material from sabot body extends through the plurality of apertures so as to link a portion of the body forward of the reinforcement member to a portion of the body aft of the reinforcement member;

wherein:

the bullet has a nominal caliber of 0.44, 0.45, or 0.50; and the sabot has dimensions effective to fire the bullet from a 20-gauge shotgun if the bullet is 0.44 or 0.45 caliber or a 12-gauge shotgun if the bullet is 0.50 caliber.

2. A sabot end bullet combination comprising: said bullet having:

front and rear cores, the rear core harder than the front core; and a jacket containing the front and rear cores separated by a transverse web of the jacket; and said sabot comprising:

a molded sabot body formed of a plastic and having:

a base portion; and a plurality of petal portions, each extending forward from a proximal root at the base portion to a distal tip and cooperating with the base portion to define a volume for accommodating the bullet in a pre-firing condition; and a reinforcement at least partially embedded in the base portion, the reinforcement being more rigid than the molded member and having:

fore and aft faces;

a lateral perimeter; and at least one aperture.

3. A method for manufacturing a saboted bullet comprising:

providing a bullet;

providing a reinforcement member having a plurality of apertures;

holding the reinforcement member;

while holding such reinforcement member, molding a sabot body around the reinforcement member, so that material from the sabot body flows into the plurality of apertures and extends therethrough so as to link a portion of the body forward of the reinforcement member to a portion of the body aft of the reinforcement member; and inserting the bullet into the sabot body, through a fore end thereof;

wherein:

the saboted bullet has a nominal caliber of 0.44, 0.45, or 0.50;

the sabot body has dimensions effective to fire the bullet from a 20 gauge shotgun if the ballet is .44 or .45 caliber or a 12 gauge shotgun if the bullet is .50 caliber; and the step of inserting comprises causing the bullet to flex petals of the sabot body outward as the bullet enters the sabot body and then allowing the petals to at least partially return toward an unflexed condition as the bullet nears a fully installed position.

* * * * *